US006568212B2

(12) United States Patent
Jacobs

(10) Patent No.: US 6,568,212 B2
(45) Date of Patent: May 27, 2003

(54) LOOPING JEWELRY ATTACHMENT TO THE EAR

(76) Inventor: Rene F. Jacobs, 9746 Saloma Ave., North Hills, CA (US) 91343

( * ) Notice: Subject to any disclaimer, the term of this patent is extended or adjusted under 35 U.S.C. 154(b) by 0 days.

(21) Appl. No.: 09/977,180

(22) Filed: Oct. 15, 2001

(65) Prior Publication Data

US 2003/0070449 A1 Apr. 17, 2003

(51) Int. Cl.[7] ..... A44C 7/00
(52) U.S. Cl. ..... 63/12; 63/13; 63/14.1
(58) Field of Search ..... 63/12, 13, 14.1, 63/14.2, 14.8; D11/40, 42

(56) References Cited

U.S. PATENT DOCUMENTS

| | | | | | |
|---|---|---|---|---|---|
| 236,935 | A | | 1/1881 | Claude | |
| 1,649,187 | A | * | 11/1927 | Reiter | 63/14.2 |
| 1,732,250 | A | * | 10/1929 | Wehse | 63/14.2 |
| 1,743,006 | A | * | 1/1930 | Prescott-Richardson | 63/12 |
| 2,009,537 | A | * | 7/1935 | Williams | 63/14.2 |
| 2,409,369 | A | * | 10/1946 | Lo Curto | 63/14.2 |
| 2,414,382 | A | * | 1/1947 | McCann | 63/14.2 |
| 2,453,485 | A | | 11/1948 | Axtell | |
| 2,498,748 | A | | 2/1950 | Barron | |
| 2,502,386 | A | | 3/1950 | Mailand | |
| D160,246 | S | * | 9/1950 | Brandano | D11/40 |
| 2,525,195 | A | * | 10/1950 | Austrin et al. | 63/14.2 |
| 2,526,087 | A | * | 10/1950 | Schoolman et al. | 63/14.2 |
| 2,542,730 | A | * | 2/1951 | Thronsen | 63/14.2 |
| D170,349 | S | | 9/1953 | Bell | |
| 2,764,000 | A | * | 9/1956 | Lippmann | 63/14.2 |
| 2,914,928 | A | * | 12/1959 | Warden | 63/14.2 |
| D189,793 | S | * | 2/1961 | Howard | D11/42 |
| 3,958,430 | A | * | 5/1976 | Barron | 63/14.2 |
| 4,282,721 | A | * | 8/1981 | Roach et al. | 63/14.1 |
| D299,119 | S | * | 12/1988 | Frederick | D11/40 |
| 4,827,738 | A | * | 5/1989 | Rothal | 63/14.1 |
| 4,993,240 | A | | 2/1991 | Pounder | |
| 5,097,682 | A | * | 3/1992 | Nakamura | 63/14.1 |
| 5,184,482 | A | | 2/1993 | Cloud | |
| D337,963 | S | * | 8/1993 | Gladorisi | D11/40 |
| D347,801 | S | | 6/1994 | Church | |
| 5,526,654 | A | * | 6/1996 | Carter | 63/14.1 |
| 5,533,363 | A | * | 7/1996 | Callisto | 63/14.1 |
| 5,809,803 | A | | 9/1998 | Stracuzzi | |
| 6,014,870 | A | | 1/2000 | Horner et al. | |
| 6,282,921 | B1 | * | 9/2001 | Carter | 63/12 |

* cited by examiner

*Primary Examiner*—William L. Miller
*Assistant Examiner*—Andrea Chop
(74) *Attorney, Agent, or Firm*—William W. Haefliger

(57) ABSTRACT

Ear jewelry, comprising in combination, a first decorative wire extending in a looping direction to conform generally to the looping periphery of a human ear, decorative ornamentation structure carried by and spaced along the wire, and support structure connected to the wire at at least one of two looping spaced locations along the wire, the support structure including at least one attachment connectible to the ear.

11 Claims, 5 Drawing Sheets

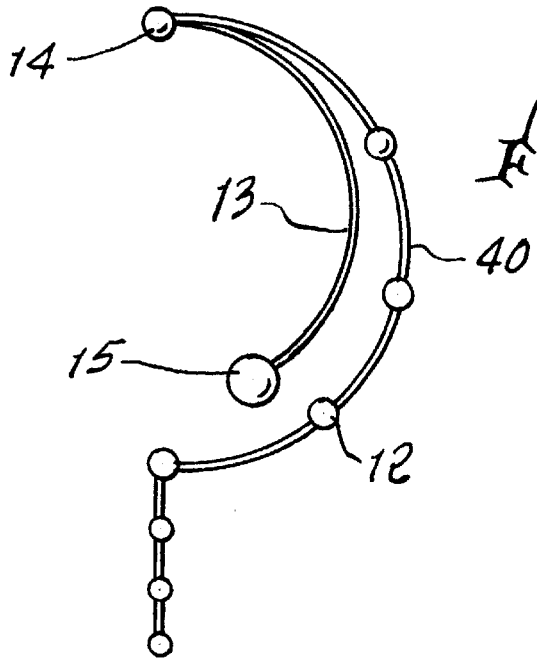
FIG. 5.
FIG. 6.
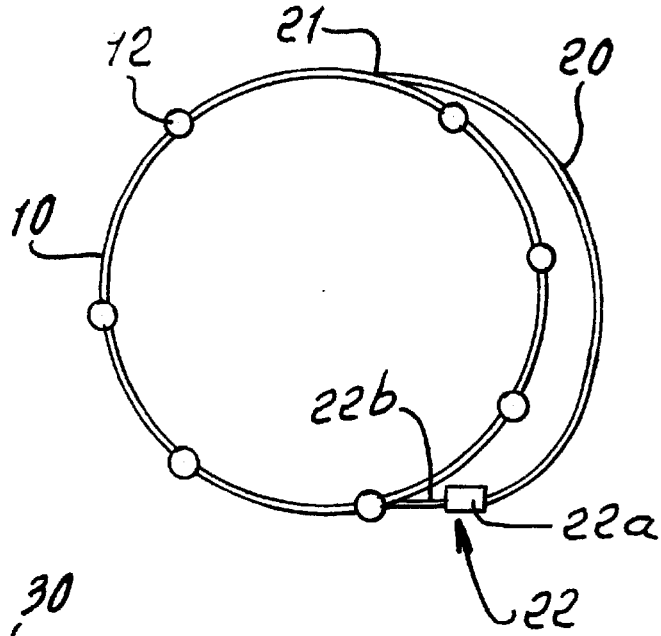
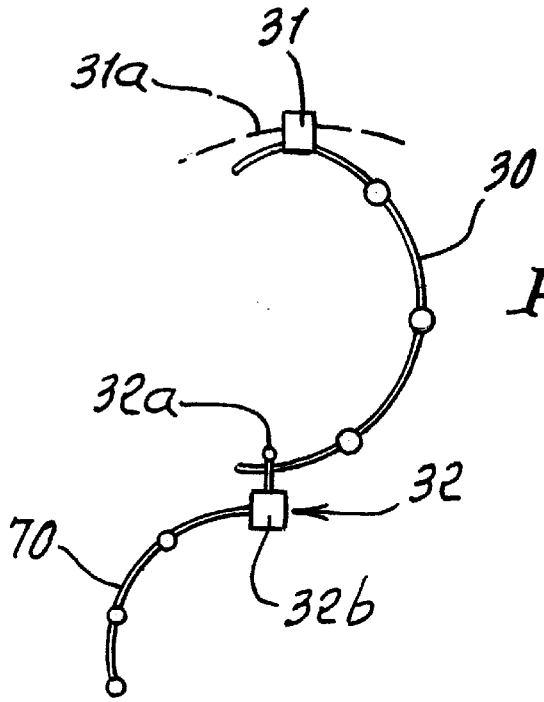
FIG. 7.

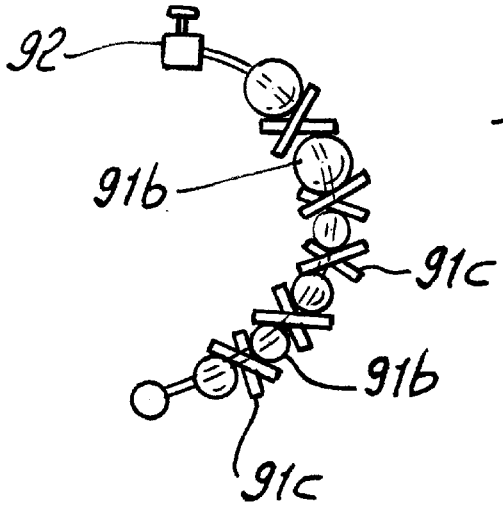
FIG. 15.
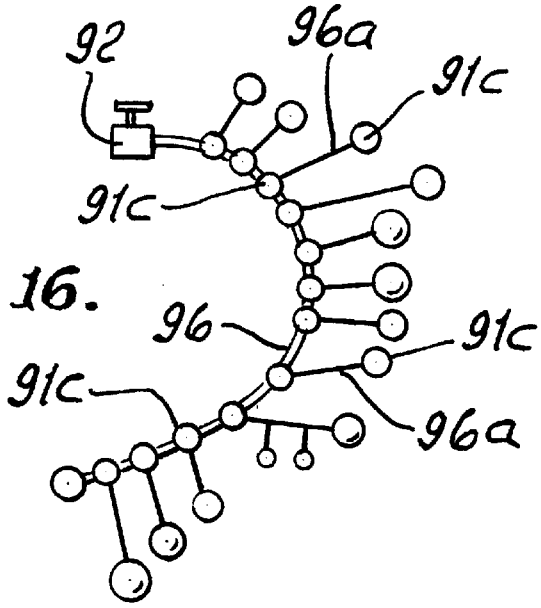
FIG. 16.
FIG. 17.
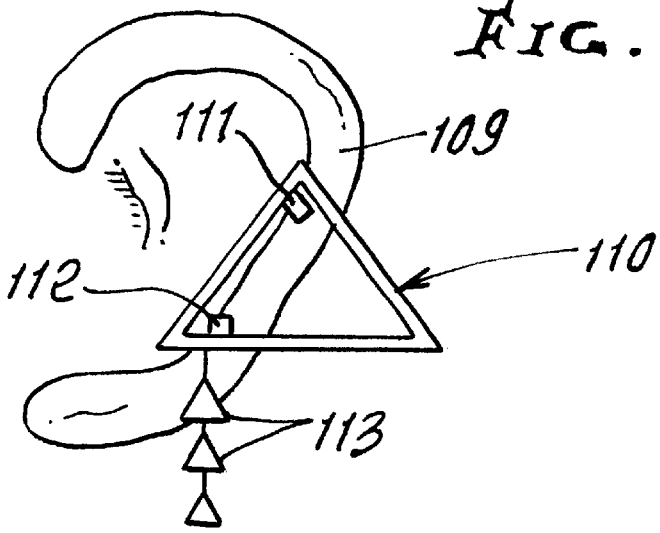

LOOPING JEWELRY ATTACHMENT TO THE EAR

BACKGROUND OF THE INVENTION

This invention relates generally to decorative jewelry attachable to the human ear; and more particularly concerns improvements in looping jewelry that conforms generally to the looping peripheral configuration of the ear.

There is need for improvements in removably attaching such looping jewelry to the ear in such a way as to provide support for a looping wire, or wires, associated with such jewelry. Also, there is need for multiple such attachments, that are removable, and at least one of which extends to the rear side of the ear, to provide security of attachment.

SUMMARY OF THE INVENTION

It is a major object of the invention to provide improvements in such looping wire jewelry, which meet the above needs. Basically, improved device of the invention comprises:

a) first decorative wire extending in a looping direction to conform generally to the looping periphery of a human ear, b) decorative ornamentation structure carried by and spaced along the wire, c) and support structure connected to the wire at at least one of two looping spaced locations along the wire, d) said support structure including at least one attachment connectible to the ear.

Such decorative'structure may include jewels.

It is another object to provide such support structure to include a looping second wire operatively connected to the first wire at said spaced locations. The looping second wire may advantageously have i) fixed connection to the first wire at one of said locations, and ii) removable connection to the first wire at the other of said locations.

A further object of the invention is to provide the support structure to include a second attachment connectible to the ear. That attachment may typically include a holder that holds to the ear; and each of the first and second attachments may include holders removably holding to the ear at such spaced locations.

Yet another object is to provide the first wire to extend between ⅓ and ⅔ of a completed loop. Also, the first wire may extend generally circularly.

An additional object is to provide a second wire which is substantially shorter than the first wire so as to extend at the inner side of the ear facing the skull for holding the first wire to the ear, at the outer side thereof.

A further object is to provide the support structure to include jewels spaced along the first wire.

An auxiliary decorative looping wire may be connected to the first wire to extend below the first wire.

That auxiliary wire may have generally the same looping size as the first wire, to enhance decorative effect.

These and other objects and advantages of the invention, as well as the details of an illustrative embodiment, will be more fully understood from the following specification and drawings, in which:

DRAWING DESCRIPTIONG

FIG. 5 is a side view of a further modification;

FIG. 6 is a side view of a further form of the invention;

FIG. 7 is a side view of yet another form of the invention;

FIGS. 12–16 are side elevational views, showing varied ornamentations integrated into support members that extend in crescent configuration; and FIG. 17 is a side elevational view of yet another decorative support member.

DETAILED DESCRIPTION

Figure 1:
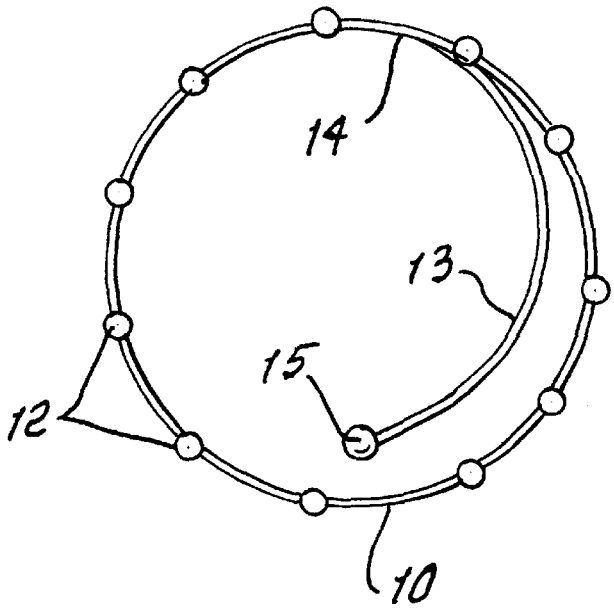
FIG. 1 is a side view of ear jewelry incorporating the invention.
Figure 2:
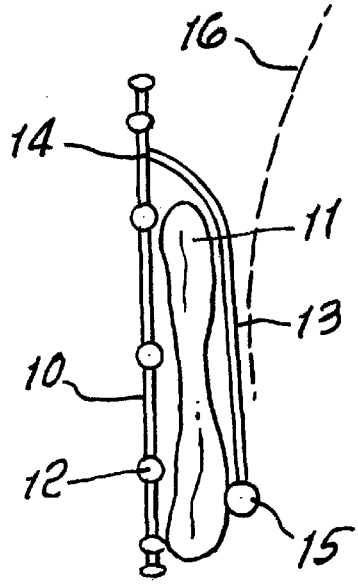
FIG. 2 is a rear view of the FIG. 1 jewelry.

In FIGS. 1 and 2, a first decorative wire 10 extends in a circularly looping direction to conform generally to the looping periphery of ear 11. Decorative or ornamentation structure is carried by and spaced along the wire; see for example jewels 12 attached to the wire at spaced locations.

Support structure is connected to the wire at at least one of two looping spaced locations, along the wire. As shown, the support structure includes a crescent shaped looping second wire 13 operatively connected to wire 10 upper location 14, the wire 13 then curving over the ear and downwardly behind the ear to terminate at an enlarged (bead-like) lower support 15, spaced from 10 and adapted to fit behind the ear, i.e. near the skull 16. See FIG. 2. This removably but firmly retains the decorative wire 10 to the outer side of the ear, with comfort.

FIG. 6 is similar, in that circularly extending wire 10 is anchored by a second crescent shaped and supporting looping wire 20 that attaches to the ear like second wire 13; however, wire 20 is amchored to wire 10 at upper location 21, and also at lower location 22. Wire 20 can be deformed as by bending at 21 and 22, to extend closer to or further from wire 10, for adjustment to and retention to the ear, at the rear side of the ear, as in FIG. 2. Connection at 22 may include a socket 22*a* and removable pin 22*b*.

FIG. 7 shows a crescent (ear) shaped decorative first wire 30, and two supports 31 and 32 attached to the wire 30 near its upper and lower ends. Support 31 may take the form of a clasp, to grasp the upper fold 31*a* of the ear, and support 32 may take the form of a pin 32*a* to project through a pierced hole in the ear lobe, and retained by a holder 32*b*. Holder 32*b* may support a lower looping decorative wire 70.

FIG. 5 is like FIGS. 1 and 2, but the decorative wire 40 is crescent shaped instead of circular. See also second wire 13 and supports 14 and 15, as in FIG. 1.

Figure 3:
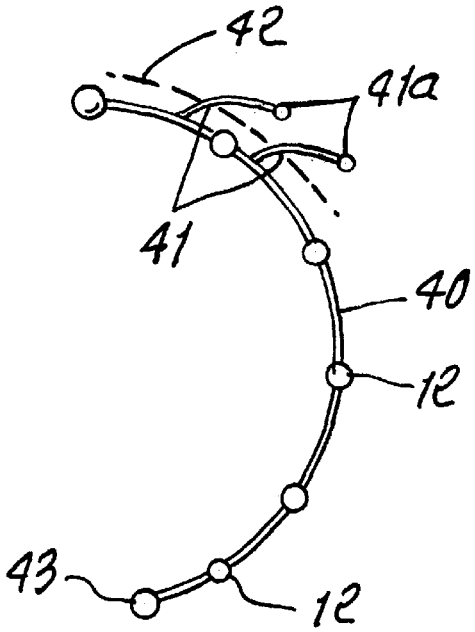
FIG. 3 is a side elevation showing another form of the invention.
Figure 4:
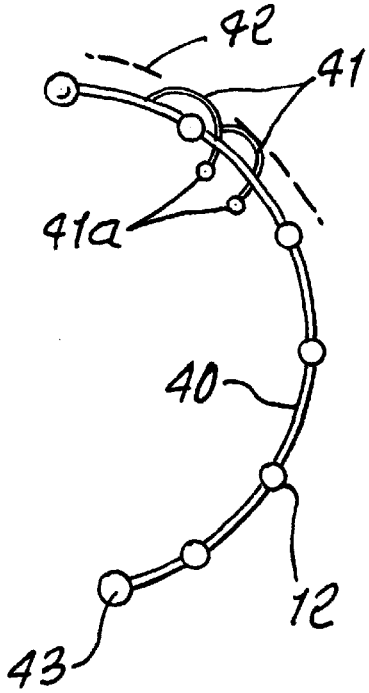
FIG. 4 is a rear view showing retention to the upper portion of the ear.

FIGS. 3 and 4 also show a crescent decorative wire 40; however, an upper support or supports take the form of bendable short wire or wires 41. They are adjustably bent downwardly as in FIG. 3 over the upper fold 42 of the ear, to comfortably retain the wire 40 in selected position. Support wires 41 may terminate at smooth enlargements 41*a*, that may comfortably engage the inner side of the ear. A lower support 43 retains wire 40 to the ear lobe, and may take the form of a clasp or pin.

In FIGS. 3, 4, 5, 6 and 7, the front decorative wire extends between ⅓ and ⅔ of a completed loop.

Figure 8:
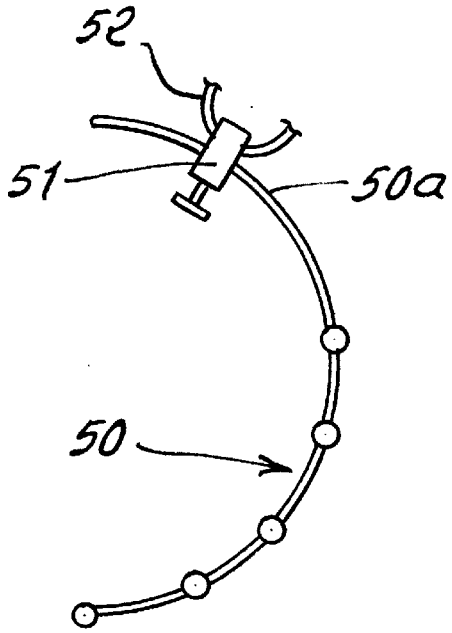
FIG. 8 is a view like FIG. 1 showing a further modification.
Figure 9:
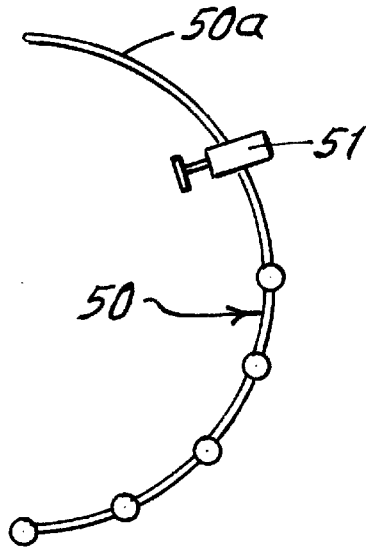
FIG. 9 is a view like FIG. 8 showing another modification.

In FIG. 8, the support wire 50 for jewelry has an extent 50*a* free of such jewelry. Extent 50*a* extends into, and is adjustably slidable in a support 51. The later may take the form of a clasp for an ear ring 52. FIG. 9 in another view of the FIG. 8 structure, after adjustable sliding of the wire in support 51.

Figure 10:
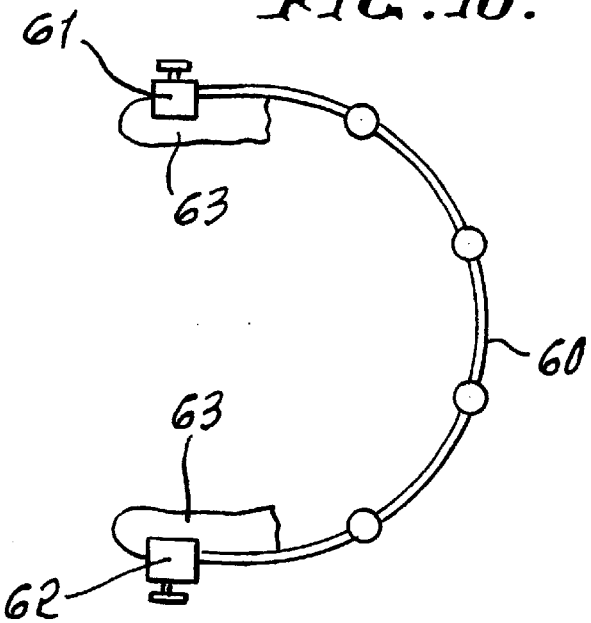
FIG. 10 is a view like FIG. 1 showing an additional modification.

In FIG. 10 the crescent-shaped wire 60 is attachable via upper and lower retainers 61 and 62 to the ear 63 of the wearer. Jewels may be carried by the wire.

Figure 11:
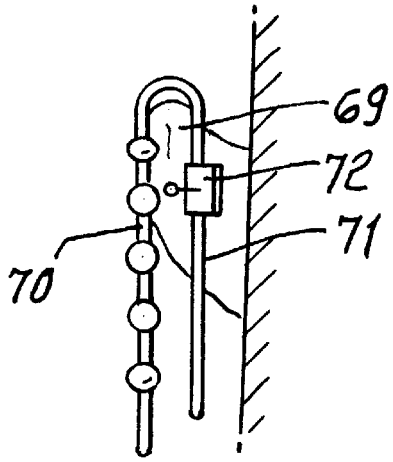
FIG. 11 is a view like FIG. 2 showing a yet further modification.

In FIG. 11 crescent-shaped wire or member 70 carries jewels at the front of the ear 69. A second wire or member 71 extends at the rear side of the ear, and is attached at 72 to wire or member 71. Attachment 72 may clip to the ear, as at a pierced location, and wire 71 may slip in the attachment, for adjustment.

Figure 12:
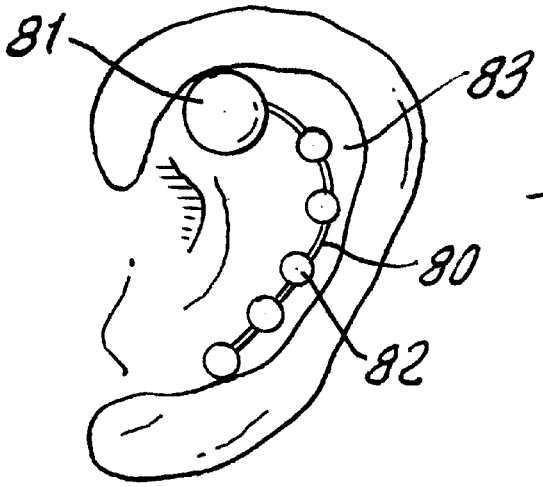

In FIG. 12, the crescent-shaped member 80 clips to the ear at 81, and extends within the ear lobe zone 83, and carries jewels 82.

Figure 13:
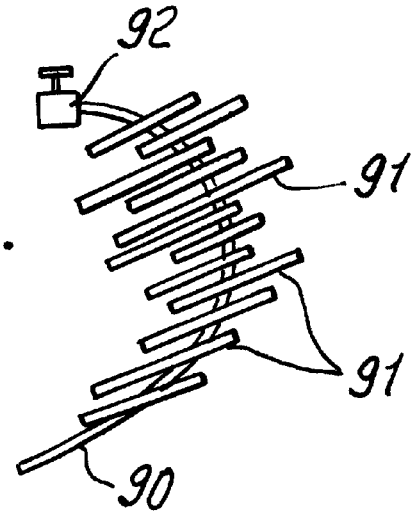
Figure 14:
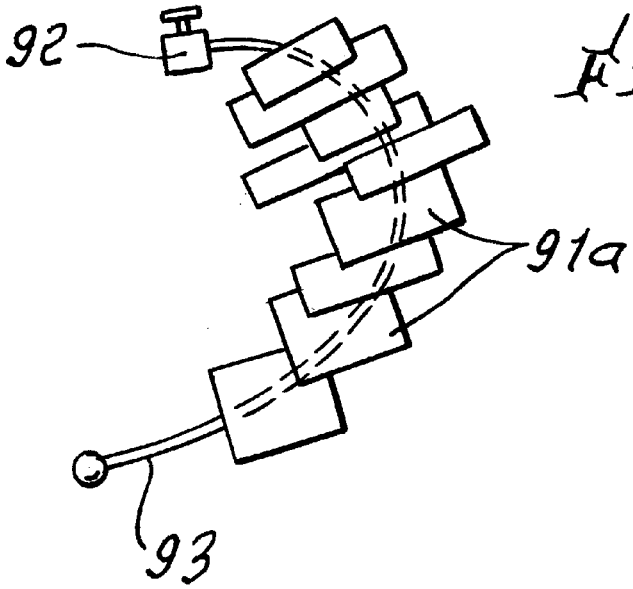

In FIG. 13 the crescent-shaped member 90 has decorative parallel jewel-like parts 91 in succession. Member 90 may clip to the ear in any of the ways referred to above as at 92. The FIG. 14, like FIG. 13, the plate-like parts 91*a* overlap one another, in series succession and are attached to wire 93. In FIG. 15, the parts 91*b* and 91*c* have alternately different configurations, such as circles and crosses. In FIG. 16, the successive parts 91*c* along wire 96 are each in the form of two jewel-like balls inter-connected by subwires 96*a*.

FIG. 17 shows a triangular decorative member 110 at the side of the ear and connected to the ear 109 as at 111 and 112. Note dangling ornaments 113.

Each of the forms shown may carry dangling jewels, as at 113 in FIG. 17.

I claim:

1. Ear jewelry, comprising in combination:

a) a first decorative wire extending in a substantially circular looping upright direction adapting it to conform generally to the looping periphery of a human ear, b) decorative ornamentation structure carried by and spaced along the wire, c) and support structure connected to the wire at at least one of two looping spaced locations along the wire, d) said support structure including a second wire operatively connected to the first wire at an upper location relative to the first wire, the second wire then looping downwardly with substantially the same curvature as the curvature of the first wire and toward a lower terminal location relative to the first wire, and spaced from but near to the first wire, so that a main looping extent of the second wire is adapted to fit behind the wearer's ear to position the two wires on the ear, e) there being an enlarged support on the second wire proximate said terminal location and sized and adapted to fit between the ear and the side of the wearer's skull to firmly position the second and first wires on the ear.

2. The combination of claim 1 wherein said looping second wire has at least one of the following:

i) fixed connection to the first wire at one of said locations, and ii) removable connection to the first wire at the other of said locations.

3. The combination of claim 1 wherein said support structure includes a second attachment connectible to the ear.

4. The combination of claim 3 wherein said second attachment includes a holder that is adapted to removably hold to the ear at said spaced locations.

5. The combination of claim 1 wherein said first wire extends between ⅓ and ⅔ of a completed loop.

6. The combination of claim 1 wherein said second wire is substantially shorter then the first wire so as to extend at the inner side of the ear facing the skull for holding the first wire to the ear, at the outer side thereof.

7. The combination of claim 1 wherein said decorative structure includes jewels spaced along the first wire.

8. The combination of claim 1 including an attachment adapted for connection to the ear, said first wire having adjustable sliding connection to the attachment.

9. The combination of claim 8 wherein the attachment has a bore, and the first wire is slidable in said bore.

10. The ear jewelry of claim 1 wherein said decorative ornamentation structure includes at least one of the following:

i) overlapping small plates spaced along the wire ii) elongated narrow sub-bodies staggered in succession along the first wire iii) jewels configured in succession to fit within the lobe of the ear iv) small generally circular bodies and cross-shaped bodies in succession along the first wire v) a triangular part having general size corresponding to the size of the ear to fit adjacent the ear vi) pairs of small bodies interconnected by sub-wires.

11. The combination of claim 1 wherein said first wire is the form of a member that has one of the following:

i) a spiral form ii) a series succession of discrete ornaments associated with said decorative ornamentation structure iii) a series succession of overlapping ornaments associated with said decorative ornamentation structure iv) a series succession of discrete ornaments including interconnected pairs of balls, associated with said ornamentation structure v) rods forming a triangle.

* * * * *